United States Patent [19]

Inglee

[11] Patent Number: 4,740,185

[45] Date of Patent: Apr. 26, 1988

[54] TOPPLING TOY AND CONSTRUCTION SET

[76] Inventor: Philip R. Inglee, 13375 Braun Rd., Golden, Colo. 80401

[21] Appl. No.: 931,244

[22] Filed: Nov. 17, 1986

[51] Int. Cl.[4] ..... A63H 33/04

[52] U.S. Cl. ..... 446/2; 446/120; 446/487; 273/86 D

[58] Field of Search ..... 446/2, 85, 108, 111, 446/120, 121, 122; 273/86 D, 86 R

[56] References Cited

U.S. PATENT DOCUMENTS

| | | | |
|---|---|---|---|
| 2,289,690 | 7/1942 | Bakalyar | 446/2 |
| 2,587,042 | 2/1952 | Haiselup | 446/2 |
| 2,713,489 | 7/1955 | Glaser | 273/86 R |
| 3,283,439 | 11/1966 | Rosen | 446/2 |
| 3,283,440 | 5/1964 | Rosen | 446/2 |
| 3,621,601 | 1/1969 | Greenberg et al. | 446/2 |
| 3,630,524 | 12/1971 | Cooper et al. | 273/86 R |
| 3,698,123 | 12/1971 | Heldt | 446/120 |
| 3,902,291 | 9/1975 | Zucht | 446/111 |
| 4,058,909 | 11/1977 | Poleri | 446/111 |
| 4,138,797 | 2/1979 | Stolar | 446/2 |
| 4,352,255 | 10/1982 | Warehime | 446/120 |
| 4,509,929 | 4/1985 | Zawitz | 446/121 |
| 4,632,664 | 12/1986 | Manning | 446/2 |

FOREIGN PATENT DOCUMENTS

| | | | |
|---|---|---|---|
| 548858 | 4/1932 | Fed. Rep. of Germany | 446/2 |
| 2218689 | 12/1972 | Fed. Rep. of Germany | 446/2 |
| 2556791 | 6/1985 | France | 446/120 |

*Primary Examiner*—Robert A. Hafer
*Assistant Examiner*—Charles H. Harris
*Attorney, Agent, or Firm*—Fields, Lewis, Pittenger & Rost

[57] ABSTRACT

A toppling toy unit and construction set enables a plurality of toy units to be assembled into a variety of structures of different configurations. Each toppling toy unit includes end-connectable track-like base sections of different shapes and configurations each with a plurality of dominoes that are pivoted to move from an up position to a down position with each held by a stop that projects up from the base section. When connected end to end when a rear-most domino is toppled the rows of dominoes topple. The base sections are straight, angled, Y-shaped, curved and stair-steps. The base section and stop are a molded plastic unitary construction. A keeper is adapted to be positioned forwardly of the front domino to stop the toppling progression at the forward domino. A pair of posts extended up from the base section are provided for each domino. Each post has an aligned opening for receiving the aligned pivot pins projecting from opposite sides of each domino. The pivot pin slide fits into the slot for assembly and disassembly of the domino to the base section.

15 Claims, 3 Drawing Sheets

TOPPLING TOY AND CONSTRUCTION SET

TECHNICAL FIELD

This invention relates to construction toys and more particularly to novel and improved releasably connectable toppling toy and a toy construction set.

BACKGROUND ART

Toy construction sets comprised of several different configurations of releasably connectable units are entertaining and may be instructional to the user. In the past such types of toy units have not had the feature of both toppling elements arranged in a series when connected and at the same time provide a high degree of versatility as to the assembled structures that can be formed. Dominoes placed upright and in a row and then toppled have been an attraction for all ages but no releasably connectable domino units or construction sets using dominoes are known to have been provided.

Examples of prior known toy units using a toppling effect are found in U.S. Pat. Nos. 2,289,690, 2,713,489, 3,621,601 and 4,138,797.

DISCLOSURE OF INVENTION

A toppling domino unit disclosed includes a base section adapted to releasably connect end to end to another similarly constructed base section and a series of spaced toppling dominoes freely pivot between up and down positions on the base section. A stop holds each toppling domino up in a backward tilt whereby a toppling force applied to a rear domino will engage the next adjacent forward domino to cause the row of the dominoes to topple in succession. The dominoes are readily reset by tilting the base section or rotating each domino back to the up position. A keeper prevents the last toppling domino on each base section from toppling. A construction set of the toppling toy units have base sections that are straight, curved, Y-shaped, stairsteps, and angles from which a variety of assembled composite structures may be formed.

DETAILED DESCRIPTION

Referring now to FIGS. 1–6 there is shown a straight toppling domino unit 15 which includes a straight base section 16 in the form of flat-sided rectangular body preferably made of a molded plastic strip. The body has a pair of pins 17 projecting from the front end and a pair of holes 18 complementary to pins 17 extending into the opposite rear end which serve as male and female coupling portions to releasably connect the base section to a similar base section as is described more fully hereinafter.

Figure 1:
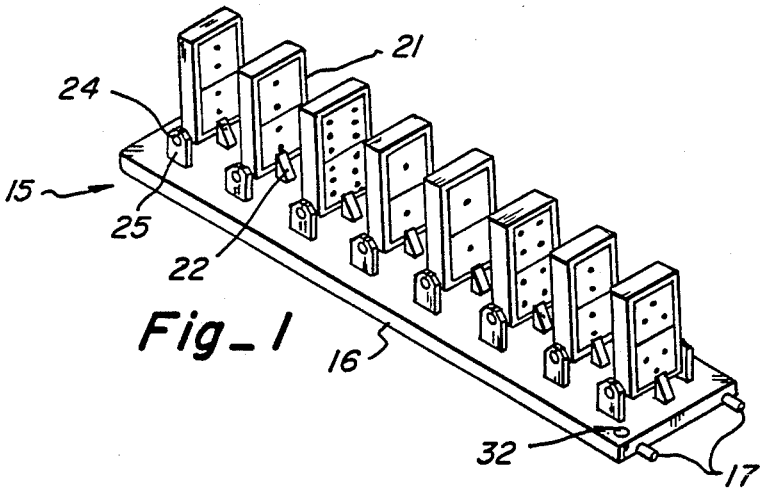
FIG. 1 is a perspective view of a toppling domino unit embodying features of the present invention with the dominoes shown in an up position.
Figure 2:
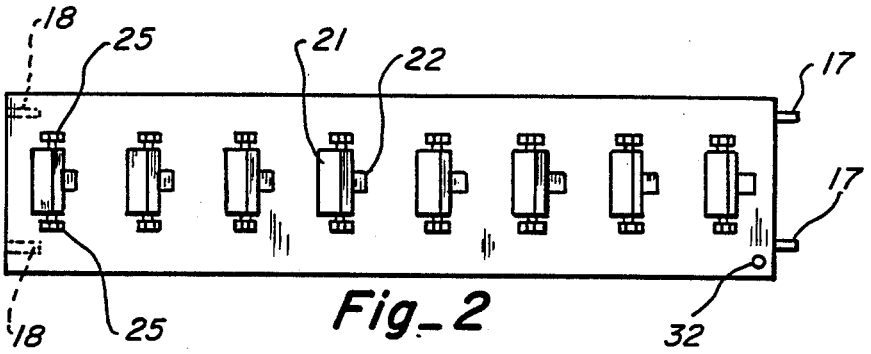
FIG. 2 is a top plan view of the unit shown in FIG. 1.
Figure 3:
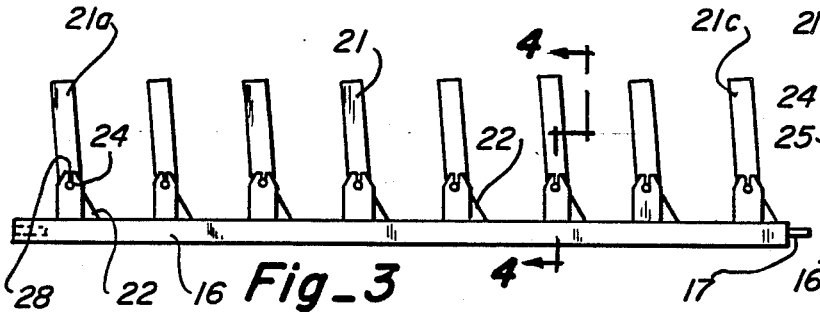
FIG. 3 is a side elevation view of the unit shown in FIG. 1.
Figure 4:
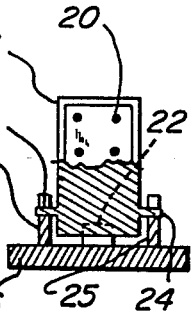
FIG. 4 is a sectional view taken along lines 4—4 of FIG. 3.
Figure 5:
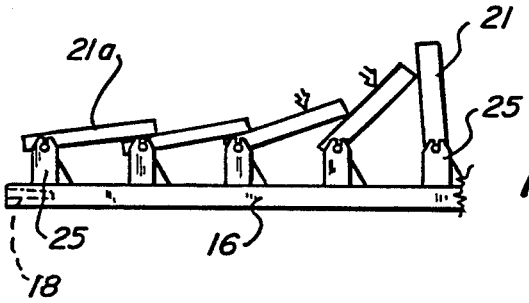
FIG. 5 is a side elevational view of a portion of the unit shown in FIG. 1 with some of the dominoes in a down position and one in a partially toppled position.

A row of toppling members shown are in the form of dominoes 21 are pivotally mounted to the top of the base section 16. A rear toppling domino is designated **21*a* and a front toppling member is designated 21*c*. Each domino is a conventional construction being a rectangular body made of wood and having a different number of dots 20 in each half section on one face thereof. Each toppling domino in an up position is generally upright and is disposed at a backward tilt angle at about 5 degrees to the vertical and as shown in FIG. 5 when a suitable toppling force is applied thereto to push it past a center position will fall forward to a down position. A raised stop 22, also preferably of molded plastic, is provided forwardly of an associated domino that projects up from the top surface of the base section and is preferably molded integral therewith to hold each domino upright. In particular, each stop 22 has a rearwardly facing vertical stop surface 23** against which a front face of an end portion of an associated domino will abut when in the up position.

The pivot mounting shown for each domino includes a pair of pivot pins 24 affixed to and projecting from the opposite sides of the domino adjacent the bottom edge and further includes a pair of laterally spaced posts 25 extending up from the top surface of the base section on each side of the dominoes. Each post has a slot 28 extending down from the top with the slot having a top opening. The slot opening and sides of the slot are sized to slidably receive an associated pivot pin 24 via the top opening. Each pair of posts 25 are disposed equal distances on opposite sides of the longitudinal center line of the base section and the associated pair of sets of slots are aligned to receive pivot pins 24 projecting from opposite sides of the dominoes. In this way each domino may be readily removed from the base if desired. The bottom surface of each slot forms a bearing surface for the pivot pins about which an associated pair of pivot pins support an associated domino for free rotation. It is understood that other types of pivot arrangements can be provided for supporting the dominoes on the base section.

Figure 6:
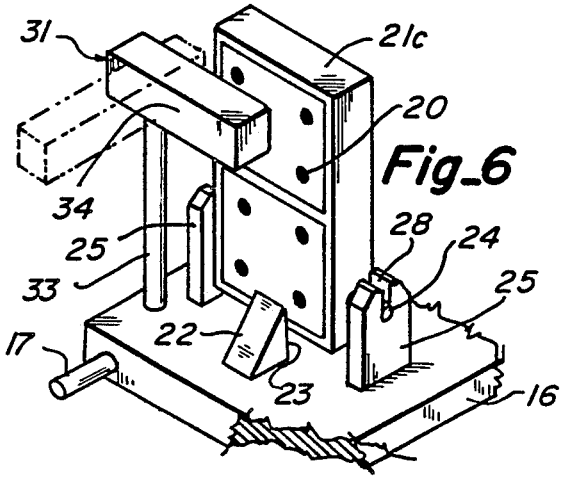
FIG. 6 is a perspective view of a keeper adjacent the forward domino disposed in the stop position with the release position shown in dashed lines.
Figure 12:
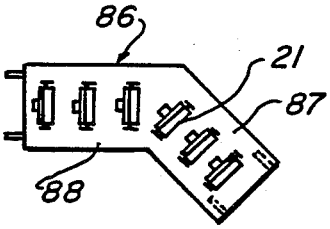
FIG. 12 is a top plan view of an angle section that turns left.

A keeper 31 is shown in FIG. 6 as mounted in a vertical hole 32 in the base section forwardly of the front toppling domino **21*c* to stop the toppling progression at the forward toppling domino. The keeper 31 is comprised of an upright pin portion 33 having its lower end releasably inserted into the hole 32 and an arm portion 34 at right angles to the pin portion that extends across the front upper face of the domino. The keeper pin portion 33 will rotate 90 degrees in the base section to clear the forward domino as shown in dashed lines or can be removed from the base section as desired. The keeper 31** is used to stop the falling progression of the dominoes should they begin to fall prematurely or unintentionally. The keeper is removed or rotated just prior to the player's initiating the domino toppling.

Figure 7:
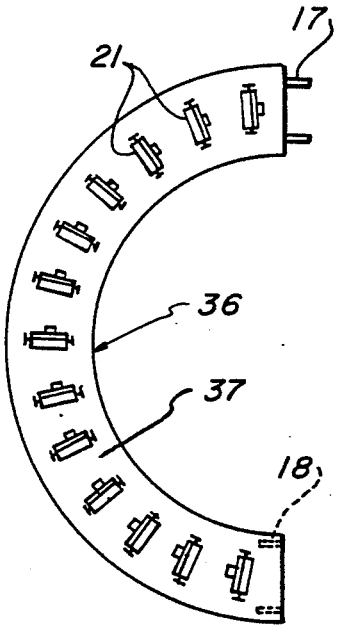
FIG. 7 is a top plan view of a curved form of unit that extends through an arc of 180 degrees.
Figure 8:
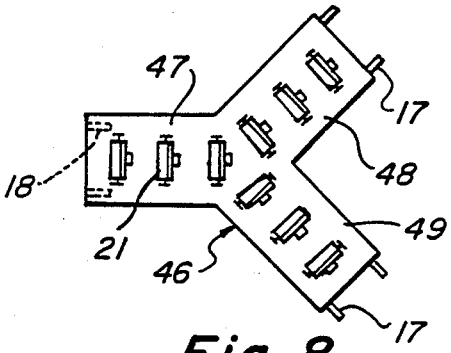
FIG. 8 is a top plan view of a Y-shaped form of unit.

Referring now to FIG. 7 there is shown a curved unit 36 having a curved base section 37 that extends through an arc of 180 degrees. This curved unit has a row of toppling dominoes 21 centered along the curved longitudinal center line of the base section 37 and has the same coupling portions 17 and 18 at opposite ends. A Y-shaped unit 46 is shown in FIG. 8 which has a straight base section 47 and angled base sections 48 and 49 which extend at angles of 45 degrees to the center line of the straight base section 47. The dominoes 21 are arranged so that the forward domino of the straight section engages the rear dominoes of the inclined sections at an angle of 45 degrees so as to divert the toppling in two directions at 90 degrees to one another.

Figure 9:
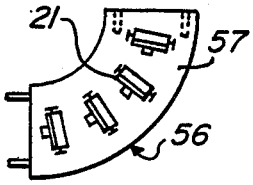
FIG. 9 is a top plan view of a right curved form of unit that extends through an arc of 90 degrees.
Figure 10:
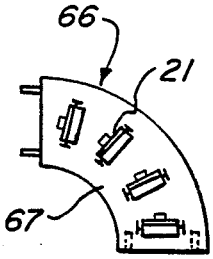
FIG. 10 is a top plan view of a left curved form of unit that extends through an arc of 90 degrees.

Referring now to FIG. 9 there is shown a right curved unit 56 with a right curved base section 57 that extends through an arc of 90 degrees and in FIG. 10 there is shown a left curved unit 66 with a left curved base section 67 that extends through an arc of 90 degrees. When the units of FIGS. 9 and 10 are connected together they form an S-shaped section.

Figure 11:
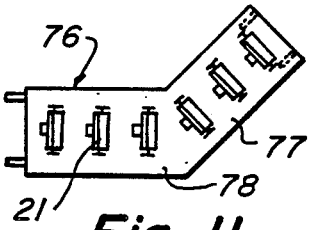
FIG. 11 is a top plan view of an angle section that turns right.

An angle unit 76 turned to the right shown in FIG. 11 has a straight base section 77 and an angled base section 78 extending right 45 degrees to the longitudinal center line of the straight base section 77. Similarly an angle unit 86 turned to the left is comprised of a straight base section 87 and an angled base section 88 extending left 45 degrees to the longitudinal center line of the straight base section 87.

Figure 13:
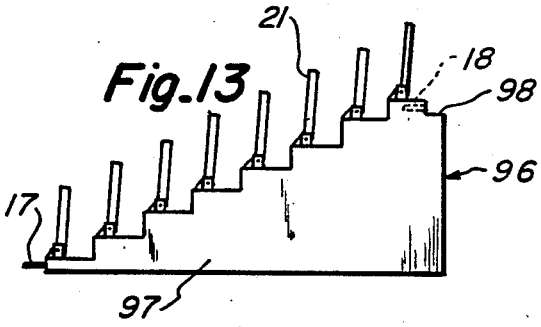
FIG. 13 is a side elevation view of a stair-step form of unit.

Referring now to FIG. 13 there is shown a down stair-step unit 96 which has a stair-step base section 97 which supports a row of the toppling dominoes 21 that are each at different elevations. In this form the dominoes topple downwardly. A notch 98 is provided at the higher end to accomodate and support the end portion of a straight base section and has a pair of spaced holes 18 as shown to form a female coupling portion. An up stair-step unit **96*a* is shown in FIG. 14 with the same construction as unit 96** but the toppling succession is up.

By way of illustration and not limitation in a set of toppling domino units a full length straight section has a base section with a length dimension of ten (10) inches and a width dimensiosn of two and one half (2.5) inches. There are eight (8) dominoes spaced one and one-fourth (1.25) inches apart with the forward and rear dominoes being about five-eights ($\frac{5}{8}$) inches from the end of the base section. A conventional domino has a length of about $1\frac{5}{8}$ inches and a width of about $\frac{3}{4}$ inches. With this dimensioning when two units are connected together the forward domino of a rear unit will engage the rear domino of the next unit to effect a toppling between connected units unless a keeper 31 is positioned to prevent the forward domino from falling. A construction set preferably would include a half-length straight section having a length of five (5) inches with four dominoes. A construction set preferably would include four different curved units. They are: A. a six (6) inch radius, an arc of 90 degrees and eight dominoes, B. a six (6) inch radius, an arc of 45 degrees with four dominoes, C. a twelve (12) inch radius, an arc of 90 degrees with fifteen dominoes, and D. a twelve (12) inch radius, an arc of 45 degrees with eight dominoes.

Figure 14:
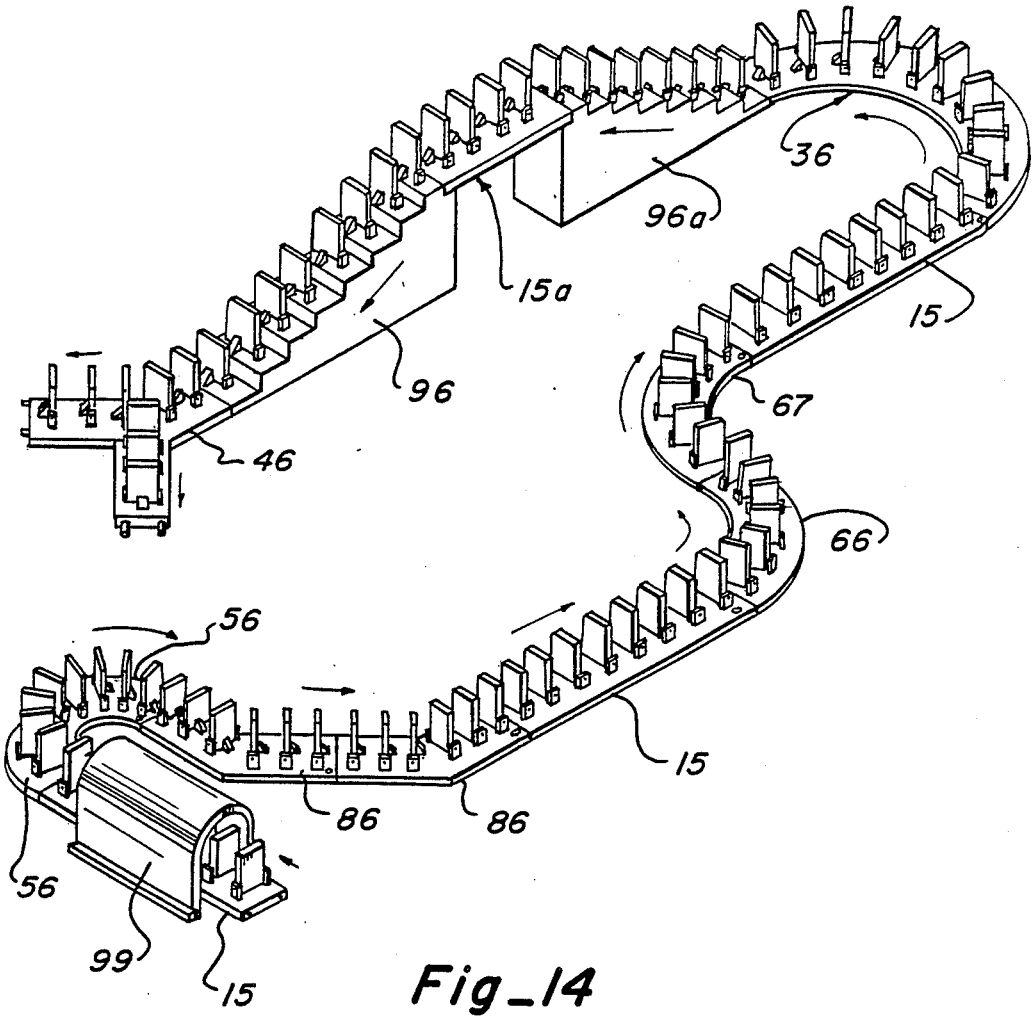
FIG. 14 is an assembly of a set of units embodying features of the present invention.

Referring now to FIG. 14 there is shown an assembly of the above described toppling domino units beginning at the rear toppling end there is a full length straight unit 15, two right curved units 56, two angle units 86, full length straight unit 15, left curved unit 66, right curved unit 67, full length straight unit 15, curved unit 36, up stair-step **96*a*, half length straight unit 15, down stair-step unit 96 and Y-shaped unit 46. A cover 99** is shown over straight section at the rear end of the assembly.

In the play the assembly such as that shown in FIG. 14 is constructed and the dominoes are pivoted to the up position. Keepers may be inserted during assembly and removed prior to setting the rear-most domino in motion which results in all of the dominoes falling down in succession.

Although the present invention has been described with a certain degree of particularity, it is understood that the present disclosure has been made by way of example and that changes in details of structure may be made without departing from the spirit thereof.

What is claimed is:

1. A releasably connectable toppling toy unit for a toy construction set comprising:

a base section having oppositely disposed male and female coupling portions adapted to releasably connect end to end to another similarly constructed base section, a row of toppling members with each said member being pivotally mounted to the base section to move about an axis of rotation between an up position and a down position, each said toppling member being disposed at a backward tilt angle in said up position and movable when forces are applied thereto to move past a vertical position to then fall forward to said down position, said members being so spaced apart that when a rear one of said members is toppled forwardly that member will engage an adjacent forward member which in turn will engage the next adjacent forward member and cause the row of said members to topple in succession to the down position, said mounting for each of said toppling members including a pair of posts extending up from a top surface of said body, each pair of posts having aligned openings for receiving aligned pivot pins projecting from opposite sides of each toppling member, each said opening being provided by a slot extending into the top of each post, each said pivot pin slide fitting into said slot for assembly and disassembly of a toppling member to the base section with a bottom surface of each slot forming a bearing surface for an associated pivot pin, and a stop forwardly of each toppling member with respect to the direction of the toppling motion and located to hold each of said toppling members from tilting further rearwardly when in said up position, said stop being in the form of a projection with a vertical stop surface extending up from a top surface of said body against which a front face of an end portion of an associated toppling member abuts.

2. A toy unit as set forth in claim 1 wherein said toppling members are dominoes.

3. A toy unit as set forth in claim 1 wherein said base section is in the form of a relatively thin flat-sided rectangular body and said male coupling portion is in the form of a pair of spaced pins projecting from one end of said body and said female coupling portion is in the form of a pair of spaced holes in the opposite end of said body.

4. A toy unit as set forth in claim 1 wherein said base section and stop are a molded plastic unitary construction.

5. A toy unit as set forth in claim 1 including a keeper adapted to be positioned forwardly of the front toppling member to stop the toppling progression at the forward toppling member.

6. A toy unit as set forth in claim 5 wherein said keeper has a pin portion that releasably inserts into a hole in the base section and an arm portion at right angles to the pin portion to engage the forward domino.

7. A toy unit as set forth in claim 1 wherein said base section is straight.

8. A toy unit as set forth in claim 1 wherein said base section is curved and extends through an arc of about 180 degrees.

9. A toy unit as set forth in claim 1 wherein said base section is curved and extends through an arc of about 90 degrees.

10. A toy unit as set forth in claim 1 wherein said base section is Y-shaped having a straight section and two angle sections at 45 degrees to the center line of the straight section.

11. A toy unit as set forth in claim 1 wherein said base section is in the form of a stair-step with said toppling members being disposed at a different elevations.

12. A toy unit as set forth in claim 1 wherein the distance from the dominoes at the ends of the base section and the end of the base section in relation to the length of each domino is such that when a similar base section is connected end to end the forward domino of one will topple the rear domino of the other.

13. A releasably connectable toppling domino unit comprising:

a track-like base section including a relatively thin flat-sided rectangular body, said body having oppositely disposed male and female coupling portions adapted to releasably connect end to end to another similarly constructed base section, a row of toppling dominoes with each said domino being pivotally mounted to said base section to move about an axis of rotation between an up position and a down position, each said domino being disposed at a backward tilt angle in said up position and movable when toppling forces are applied thereto to move past a vertical position to then fall forward to said down position, said dominoes being so spaced apart that when a rear one of said dominoes is toppled forwardly that domino will engage an adjacent forward domino which in turn will engage the next adjacent forward domino and cause the row of said members to topple in succession to the down position, said mounting for each of said toppling dominoes including a pair of posts extending up from a top surface of said body, each pair of posts having aligned openings for receiving aligned pivot pins projecting from opposite sides of each toppling domino, each said opening being provided by a slot extending into the top of each post, each said pivot pin slide fitting into said slot for assembly and disassembly of a toppling domino to the base section with a bottom surface of each slot forming a bearing surface for an associated pivot pin, and a stop forwardly of each toppling domino with respect to the direction of the toppling motion and located to hold each of said dominoes from tilting further rearwardly when in said up position, said stop being in the form of a projection with a vertical stop surface extending up from a top surface of said body against which a front face of an end portion of an associated toppling domino abuts.

14. In an assembly of first and second toppling toy units the combination comprising:

a pair of base sections releasably connected end to end, said base sections having oppositely disposed male and female coupling portions releasably connected end to end, each said base section having, a row of toppling members with each said member being pivotally mounted to the associated base section to move about an axis of rotation between an up position and a down position, each toppling member being disposed at a backward tilt angle in said up position and movable when forces are applied thereto to move past a vertical position to then fall forward to said down position, said members being so spaced apart and the end members of each base section being so spaced apart so that when a rear one of said members is toppled forwardly that member will engage an adjacent forward member which in turn will engage the next adjacent forward member and cause the row of said members of both base sections to topple in succession to the down position, said mounting for each of said toppling members including a pair of posts extending up from a top surface of said body, each pair of posts having aligned openings for receiving aligned pivot pins projecting from opposite sides of each toppling member, each said opening being provided by a slot extending into the top of each post, each said pivot pin slide fitting into said slot for assembly and disassembly of a toppling member to the base section with a bottom surface of each slot forming a bearing surface for an associated pivot pin, and a stop forwardly of each toppling member with respect to the direction of the toppling motion and located to hold each of said toppling members from tilting further rearwardly when in said up position, said stop being in the form of a projection with a vertical stop surface extending up from a top surface of said body against which a front face of an end portion of an associated toppling member abuts.

15. A construction set of toppling toy units capable of being assembled into a composite structural assembly at a given site, said set comprising:

a plurality of toppling toy units with each said unit including a base section having oppositely disposed male and female coupling portions adapted to releasably connect end to end to another base section, said base sections being of a variety of different shapes including straight, Y-shaped, angles, curves and stair-step to provide a variety of assembled structures, each said base section having, a row of toppling members with each said member being pivotally mounted to an associated base section to move about an axis of rotation between an up position and a down position, each said toppling member being disposed at a backward tilt angle in said up position and movable when forces are applied thereto to move past a vertical position to then fall forward to said down position, said members being so spaced apart that when a rear one of said members is toppled forwardly that member will engage an adjacent forward member which in turn will engage the next adjacent forward member and cause the row of said members to topple in succession to the down position, said mounting for each of said toppling members includes a pair of posts extending up from a top surface of said body, each pair of posts having aligned openings for receiving aligned pivot pins projecting from opposite sides of each toppling member, each said opening being provided by a slot extending into the top of each post, each said pivot pin slide fitting into said slot for assembly and disassembly of a toppling member to the base section with a bottom surface of each slot forming a bearing surface for an associated pivot pin, and a stop forwardly of each toppling member with respect to the direction of the toppling motion and located to hold each of said toppling members from tilting further rearwardly when in said up position, said stop being in the form of a projection with a vertical stop surface extending up from a top surface of said body against which a front face of an end portion of an associated toppling member abuts.

* * * * *